United States Patent [19]

Osbolt

[11] 3,961,518

[45] June 8, 1976

[54] CRIMPING DEVICE

[76] Inventor: Frank J. Osbolt, 4410 Santee, Houston, Tex. 77018

[22] Filed: Nov. 11, 1974

[21] Appl. No.: 522,478

[52] U.S. Cl. ..... 72/409; 113/54 R

[51] Int. Cl.[2] ..... B21D 5/01

[58] Field of Search ..... 72/409, 387, 479, 458, 72/457; 113/54; 29/243.5

[56] References Cited

UNITED STATES PATENTS

| | | | |
|---|---|---|---|
| 2,126,225 | 8/1938 | Simons | 72/409 |
| 2,572,738 | 10/1951 | Lovinggood | 72/409 |
| 3,180,128 | 4/1965 | Faulkner | 72/409 |
| 3,330,147 | 7/1967 | Wieters | 72/409 |
| 3,477,272 | 11/1969 | Hunter | 113/54 |
| 3,570,299 | 3/1971 | Wieters | 113/54 |
| 3,602,032 | 8/1971 | Skintzis | 113/54 |
| 3,777,687 | 12/1973 | Colman | 113/54 |

*Primary Examiner*—C. W. Lanham
*Assistant Examiner*—Gene P. Crosby
*Attorney, Agent, or Firm*—Pravel & Wilson

[57] ABSTRACT

A new and improved crimping tool for crimping into position a new door panel for a door frame of a vehicle, wherein a crimping element is pivotally mounted within an elongated housing for rotation between an initial and crimping position, the crimping member being rotated by an actuator shaft which is moved forwardly by the pivoting of a handle member. The crimping member includes a crimping face for moving the door panel edge from an initial L-shaped position to a final crimped position.

7 Claims, 3 Drawing Figures fig.1
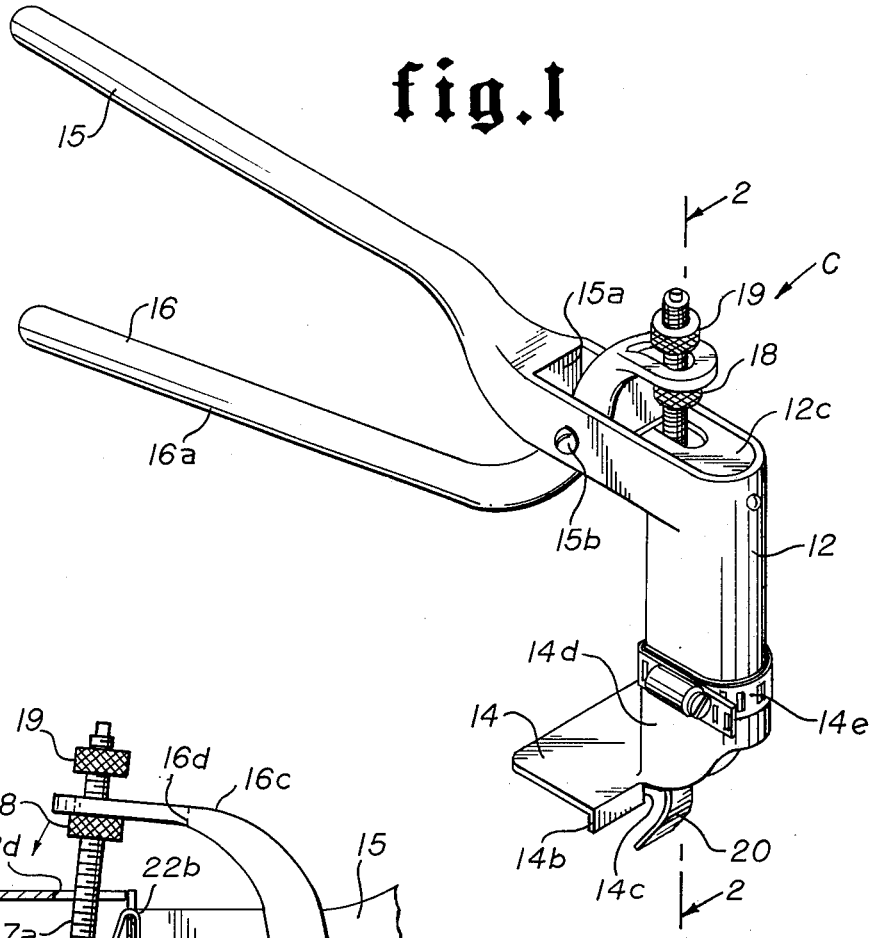
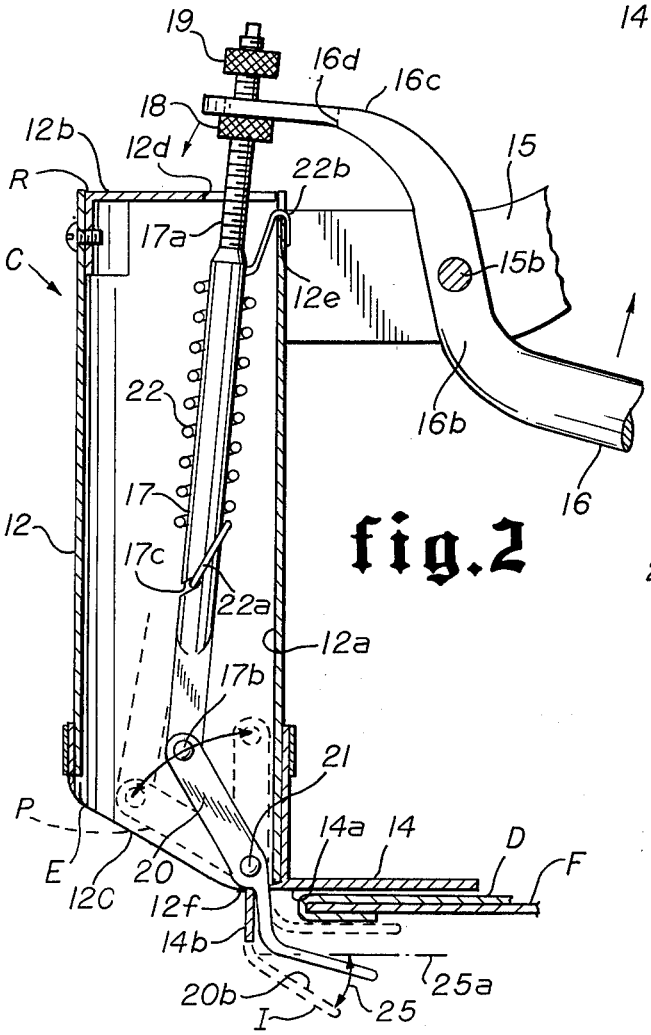
fig.2
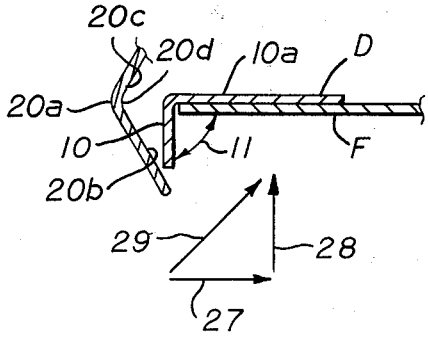
fig.3

CRIMPING DEVICE

BACKGROUND OF THE INVENTION

The field of this invention is devices for replacing damaged door panels or the like on vehicles without having to remove the entire door frame.

Insofar as known, the most common method for replacing a damaged door panel requires that the entire door be removed from the vehicle body in order to allow the mechanic access to the door frame for removing the damaged door panel and replacing same. U.S. Pat. No. 3,180,128 discloses a crimping tool for crimping a new panel onto the door frame without having to remove the door frame. The purpose of the tool disclosed in the Faulkner patent is to save the mechanic a significant amount of labor in having to first remove and thereafter replace and realign the entire door. The Faulkner patent discloses the use of a main shaft member having a L-shaped end portion for crimping a door panel over the door frame. However, in many cases, the door panel edge initially extends at approximately a right angle with respect to the door frame, and use of a device such as disclosed in the Faulkner patent may cause the door panel edge to be unevenly bent and thus unevenly crimped.

SUMMARY OF THE INVENTION

This invention relates to a new and improved device for crimping a vehicle door panel or the like onto the vehicle door frame without having to remove the door frame from the vehicle. The new and improved crimping device includes an elongated, hollow housing having a first handle member fixedly mounted at the rear end thereof and a second handle member pivotally mounted for movement with respect to the first handle member. An actuator shaft is positioned within the hollow housing and is connected to the second handle member for movement in response to pivoting of the second handle member. A crimping member is mounted at the front end of the housing for pivoted movement with respect to the housing, the crimping member being attached to the actuator shaft. The crimping member further includes a crimping face or surface which is initially disposed at an acute angle with respect to an anvil face for engaging a door frame edge which is initially perpendicular to the door frame. The crimping member is rotatable to a crimped position wherein the crimping face is approximately parallel to the door frame and in which position the door edge is crimped downwardly against the door frame.

BRIEF DESCRIPTION OF THE DRAWINGS

FIG. 1 is an isometric view of the improved crimping device of the preferred embodiment of this invention;

FIG. 2 is a sectional view taken along 2—2 of FIG. 1 of the crimping device illustrating various positions of the rotatable crimping member; and FIG. 3 is a partially schematic view illustrating the initial position of the crimping member with respect to the door panel edge.

DESCRIPTION OF THE PREFERRED EMBODIMENT

Referring to the drawings, the letter C designates a new and improved crimping device of the preferred embodiment of this invention. The crimping device C is utilized in particular to crimp a new vehicle door panel D onto a vehicle door frame F in order to alleviate the necessity of having to remove the entire door in order to replace a damaged door panel. Referring in particular to FIG. 3, the door panel D includes an outer edge 10 which may be initially disposed at a 90° angle designated at 11 (perpendicular) to the edge of the door frame F. The crimping device C of this invention is utilized to move the door panel edge 10 from this initial, L-shaped or perpendicular position, to a crimped position in which the door panel edge 10 is crimped against the inside of the door frame F. Although the crimping device C of the preferred embodiment of this invention is utilized in particular on vehicle doors, it should be understood that it is within the scope of this invention to utilize the crimping device C on other parts of a vehicle, such as a station wagon tailgate, wherein the same principles may be applied.

The crimping device C of the preferred embodiment of this invention includes an elongated cylindrical, hollow tool housing 12 that has a chamber **12*a* formed therein. The housing 12 is closed at the rear end R thereof by a rear end plate 12*b* and is closed at the front end E thereof by a front end plate 12*c*. The front and rear end plates 12*c* and 12*b* are attached to said housing 12 by screws or other suitable means. An anvil member 14 is attached by welding or other suitable means to the bottom of the front end E of the tool housing 12 and includes a flat, anvil face 14*a* which is placed against the door panel D in order to position the crimping tool C for use. The anvil portion 14 is L-shaped and includes an upper lateral edge 14*b* which extends outwardly therefrom. The lateral edge 14*b* is interrupted by a slot 14*c*, which slot is aligned with the tool housing 12. The anvil 14 includes a base portion 14*d* that conforms to the exterior configuration of the housing 12 and is mounted with the housing 12 by a band 14*e*** or other suitable means.

A first handle member 15 is fixedly mounted by welding or other suitable means onto the tool housing 12. The handle member 15 includes a recess **15*a* for receiving a second, pivoting handle member 16. The pivoting handle member 16 is a one-piece member that may be defined as including a lower straight portion 16*a* which is gripped by the user, a curved intermediate portion 16*b* and an upper portion 16*c*. The intermediate handle portion 16*b* extends through the first handle member recess 15*a* in order to pivotally connect the pivoting handle member 16 for movement with respect to the fixed handle member 15. The pivotal connection is accomplished by any suitable pin connection such as 15*b*. The upper, pivoting handle member portion 16*c* has an opening 16*d* therein for receiving an actuator shaft 17.**

The actuator shaft 17 is an elongated rod having a threaded rear end portion **17*a* which extends through an opening 12*d* in the housing rear end plate 12*b* and further through pivoting handle member opening 16*d*. Knurled nuts 18 and 19 are mounted on the actuator shaft rear end portion 17*a* on either side of the upper pivoting handle member portion 16*c* for controlling the position of the actuator shaft 17. The actuator shaft 17 is connected by a pin connection at 17*b* to a crimping member 20.**

The crimping member 20 is mounted for pivotal movement with respect to the housing 12 by a connecting pin 21 which extends through the housing 12 and through the crimping member 20. The crimping member 20 is rotatable by its pivotal connection to actuator shaft 17 at 17*b* between an initial position illustrated in scored lines and designated as I and a final, crimping position illustrated in scored lines and designated as P. The crimping member 20 is urged to the initial position I by means of a coil spring 22 which is connected in tension to the actuator shaft 17. The coil spring 22 includes a hooked end portion 22*a* connected in a slot 17*c* in the actuator shaft 17 and a hooked end portion 22b connected in an opening 12*e* in the tool housing 12.

The crimping member portion 20*a*, which extends outwardly of an opening 12*f* in front end member 12*c* of the tool housing 12, is adapted to engage and crimp the door panel edge 10 against the door frame F. The crimping member portion 20*a* includes a first crimping face or surface 20*b* which is connected to a second crimping face 20*c* or surface by a curved intermediate surface 20*d*, all of which surfaces cooperate to engage the door panel edge 10 and move the door panel edge 10 to a crimped position in response to rotation of the entire crimping member 20 by forward movement of the actuator shaft 17.

The crimping face 20*d* is positioned at an acute angle 25 with respect to a line 25*a* substantially parallel to the door frame F, or main door panel section 10*a* or the anvil face 14*a*. The positioning of the crimping face 20*b* at such an acute angle allows the crimping face 20*b* to engage and slide over the initially perpendicular outer door panel edge 10 as the crimping member 20 is rotated by the forward movement of the actuator shaft 17. The combination of the initial, acute angular position of the crimping face 20*b* and the rotative movement of the entire crimping member 20 allows this initially perpendicular outer door panel edge 10 to be smoothly bent to a finally crimped position against the inside of the door frame F. Further, the rotative movement of the crimping member 20 in combination with the initial, acute angular displacement of the crimping face 20*b*, will even allow a crimping edge 10 to be moved inwardly and neatly crimped against the door frame F even if the edge is positioned at an obtuse angle at 11 with respect to the door frame F and main door panel section 10*a*.

The second crimping face 20*c* and the curved intermediated surface 20*d* can cooperate with the crimping surface 20*b* to engage and crimp the door edge 10, depending on the width and initial position of the door edge 10. For the purposes of description, the crimping surfaces 20*b*, 20*c* and 20*d* have been described as separate faces or surfaces, however, it should be understood that the curvatures given to these surfaces may be such as to provide one continuous crimping surface. The important and critical point being that the initial, angular position of the outer crimping face 20*b* is positioned at an acute angle with respect to the anvil face 14*a* for moving the initially perpendicular door panel edge 10 from that initial perpendicular position to a final, crimped position against the door frame F.

The knurled nut 18 positioned in front of the upper, pivoting handle member portion 16*c* is threadably mounted onto the threaded actuator shaft end portion 17*a* for adjusting the initial and final positions of the crimping member 20. For example, rotation of the knurled nut 18 toward the knurled nut 19 will cause the final position of the inner crimping face 20*d* to be closer to the anvil face 14*a*. The purpose of such an adjustment is to allow for a smooth crimping action in spite of different thicknesses of door panels D and door frames F.

The initial perpendicular position of the outer door panel edge 10 requires the application of both a downward force in direction of arrow 27 and a lateral or longitudinal force in directon of arrow 28. Prior art devices could provide only a longitudinal force. In the device C disclosed herein, the rotative movement of the crimping portion 20*a* causes a resultant force 29, which acts in component forces in the direction of both arrows 27 and 28, to push the outer edge 20 both downwardly and inwardly to a crimped position.

The foregoing disclosure and description of the invention are illustrative and explanatory thereof, and various changes in the size, shape, and materials as well as in the details of the illustrated construction may be made without departing from the spirit of the invention.

I claim:

1. Apparatus for crimping a vehicle door panel or the like onto the vehicle door frame without having to remove said door frame from said vehicle, comprising:

an elongated hollow housing having a first handle member fixedly mounted at the rear end thereof and a second handle member mounted onto said first handle member for pivotal movement with respect thereto;

an actuator shaft member positioned in said elongated housing and connected to said second handle member for movement in response to pivotal movement of said second handle member;

a crimping member positioned in said housing and having a crimping portion extending outwardly from the front of the housing;

means mounting said crimping member onto said housing at the front end thereof for pivotal movement with respect to said housing and means pivotally connecting said crimping member to said actuator shaft; and said housing having an anvil face mounted at the front end thereof such that a door frame and panel are receivable between said crimping portion and said anvil face, said crimping portion being rotated downwardly and inwardly toward said anvil face and having means for adjusting the amount of rotation of said crimping member thereby crimping said door panel to said frame in response to movement of said second handle member toward said first handle member.

2. The structure set forth in claim 1, including;

means pivotally connecting said second handle to said actuator shaft; and said actuator shaft being moved forwardly in said housing to rotate said crimping member to a crimping position.

3. The structure of claim 1, wherein:

said actuator shaft includes a threaded section adjacent said second handle member connection means, said threaded section adapted to be received in an opening formed in said second handle member; and threaded adjustment means for positioning said second handle member at a desired position adjacent said threaded section of said actuator shaft for adjusting the amount of rotation of said crimping member.

4. The structure set forth in claim 1, including:

said crimping portion having a crimping face for engaging an edge of said door panel and crimping said door panel edge over said frame, said crimping face being initially disposed at an acute angle with respect to said anvil face; and said crimping portion having a second crimping face adjacent said first-mentioned crimping face, said second crimping face being obliquely disposed with respect to said first-mentioned crimping face.

5. The structure set forth in claim 4, including:

said crimping face being movable to a crimping position in which said face is substantially parallel to said anvil face for crimping said door panel edge about said door frame.

6. Apparatus for crimping a vehicle door panel or the like onto the vehicle door frame without having to remove said door frame from said vehicle, comprising:

an elongated hollow housing having a first handle member fixedly mounted at the rear end thereof and a second handle member mounted onto said first handle member for pivotal movement with respect thereto;

an actuator shaft member positioned in said elongated housing and connected to said second handle member for movement in response to pivotal movement of said second handle member;

a crimping member positioned in said housing and having a crimping portion extending outwardly from the front of the housing;

a coil spring connected in tension to said housing and to said actuator shaft for holding said crimping member in an initial position;

means mounting said crimping member onto said housing at the front end thereof for pivotal movement with respect to said housing and means pivotally connecting said crimping member to said actuator shaft; and said housing having an anvil face mounted at the front end thereof such that a door frame and panel are receivable between said crimping portion and said anvil face, said crimping portion being rotated downwardly and inwardly toward said anvil face thereby crimping said door panel to said frame in response to movement of said second handle member toward said first handle member.

7. The structure set forth in claim 6, wherein:

said coil spring is disposed within said elongated hollow housing.

* * * * *